US006139244A

United States Patent [19]

VanRaden

[11] Patent Number: 6,139,244

[45] Date of Patent: Oct. 31, 2000

[54] AUTOMATED FRONT LOADER COLLECTION BIN

[76] Inventor: Wayne B. VanRaden, 15090 SW. 150th Ct., Beaverton, Oreg. 97007

[21] Appl. No.: 09/478,158

[22] Filed: Jan. 5, 2000

Related U.S. Application Data

[63] Continuation of application No. 09/305,843, May 5, 1999, abandoned, which is a continuation of application No. 09/169,840, Oct. 9, 1998, abandoned, which is a continuation of application No. 08/424,175, Apr. 19, 1995, abandoned.

[51] Int. Cl.[7] ..... B65F 3/04

[52] U.S. Cl. ..... 414/408

[58] Field of Search ..... 414/406, 407, 414/408, 409, 404, 303, 419–421, 551–555, 680

[56] References Cited

U.S. PATENT DOCUMENTS

| | | | |
|---|---|---|---|
| 3,576,215 | 4/1971 | Brady et al. | 414/408 X |
| 4,219,298 | 8/1980 | Stragier et al. | 414/409 |
| 4,597,712 | 7/1956 | Smith | 414/555 X |
| 4,708,570 | 7/1986 | Smith et al. | 414/408 |
| 4,726,726 | 2/1988 | Dossena et al. | 414/404 X |
| 5,026,104 | 6/1991 | Pickrell | 414/406 X |
| 5,209,537 | 5/1993 | Smith et al. | 414/408 X |
| 5,308,211 | 5/1994 | Bayne | 414/408 |
| 5,360,310 | 11/1994 | Jones et al. | 414/409 |
| 5,391,039 | 2/1995 | Holtom | 414/408 |
| 5,484,245 | 1/1996 | Zopf | 414/408 |
| 5,607,277 | 3/1997 | Zopf | 414/408 |
| 5,639,201 | 6/1997 | Curotto | 414/408 |

FOREIGN PATENT DOCUMENTS

| | | | |
|---|---|---|---|
| 405428 | 1/1991 | European Pat. Off. | 414/408 |
| 25457 | 12/1993 | WIPO | 414/408 |

OTHER PUBLICATIONS

Bear Refuse Systems' Bear Claw Advertisement "Turns Your Front Loader into an Automated Side Loader", Cited by Applicant as Having a Date at Least One Year Prior to Filing Date.

The Bear Claw Advertisement "The Best Invention Since the Frontloader" by Bear Claw Refuse Systems, Cited by Applicant as Having a Date at Least One Year Prior to Filing Date.

*Primary Examiner*—Steven A. Bratlie

*Attorney, Agent, or Firm*—Chernoff, Vilhauer, McClung & Stenzel, LLP

[57] ABSTRACT

A dumping apparatus for an industry standard conventional front loading refuse truck having a lifting mechanism for engaging a container and dumping its contents into the truck. The container has at least one upright side and supports for engagement by the refuse truck lifting apparatus. A rail having a first end and a second end is connected to the side of the container. An elongate sliding member is horizontally slidably connected to the rail. An elongate extension member is moveable between a retracted position and an extended position, wherein the extension member is detachably interposed between the container and the sliding member at the second end of the rail. The rail is reversibly attachable to the container so that its first end can face in either direction. A first end of an elongate extension arm is rotatably connected to the sliding member. A reversable clamp assembly to grasp objects therein is connected to a second end of the extension arm which is rotatable from a first lowered position to a second raised position to enable objects grasped by the clamp assembly to be emptied into the container in either the extended sliding member position or the retracted position.

23 Claims, 6 Drawing Sheets

AUTOMATED FRONT LOADER COLLECTION BIN

This is a continuation of Application Ser. No. 09/305,843 filed May 5, 1999, now abandoned, which is a continuation of application Ser. No. 09/169,840 filed Oct. 9, 1998, now abandoned, which is a continuation of application Ser. No. 08/424,175 filed Apr. 19, 1995, now abandoned.

BACKGROUND OF THE INVENTION

The present invention relates to an automated side loading container for waste material that operates in conjunction with an industry standard, conventional front loading refuse truck.

Waste materials are commonly removed from households and small companies by depositing the waste materials in refuse cans which are placed by the curb for removal by a local disposal company. Disposal companies operate refuse or garbage trucks that drive alongside the refuse or trash cans to remove the waste. To empty a refuse can, a worker jumps off the rear of the refuse truck, lifts the refuse can emptying its contents into the refuse truck, replaces the refuse can, and returns to the refuse truck. Thereafter, a refuse truck driver drives to the next refuse can and the process is repeated. This procedure normally requires at least two workers, namely a driver and a person to empty the refuse cans. Also, an array of injuries may result from repeatedly lifting refuse cans, and boarding and deboarding slow-moving trucks.

Refuse trucks are available that have a mechanism that mechanically grips refuse cans and dumps them into the truck. However, their trucks, known as automated side loaders, are very expensive. Furthermore, they are only useful for automated refuse can pickup and are not capable of lifting a trash bin as is possible with a conventional front loading refuse truck. As a result, a refuse disposal company desiring to have automated refuse can pickup must purchase both automated side loaders and conventional front loaders.

Bear Refuse Systems has marketed a product, sold under the trademark BEAR CLAW, that simplifies the removal of household waste. The Bear Claw is a rectangular container designed to mount on the front forks of a front end loading refuse truck. The front side of the container includes a pair of horizontally oriented rails on which a wide rack is slidably mounted. Each of the rails is simply a piece of angle iron. The rack is constructed of a rectangular tubular frame that includes three short retaining pieces on both the top and the bottom that extend over the rails to maintain and permit the rack to slide along the rails. The rails are spaced a significant distance apart to accommodate the wide rack. Sliding the retaining pieces directly on the rails causes significant wear to both.

The rack is moved horizontally on the rails by the extension and retraction of a tubular cylinder located above the rack. The cylinder is connected to the upper corner of the rack. The pressure exerted on the upper corner of the rack has a tendency to torque and twist the rack, and particularly the retaining pieces, which, if bent could inadvertently cause the rack to detach from the rails. Further, the pressure exerted on the retaining pieces may loosen the rack requiring maintenance to maintain a suitable fit.

An extension arm includes a claw assembly at one end and is pivotally connected at the other end to the rack at a position adjacent to the lower rail. With the extension arm in a lowered substantially horizontal position it is extended to one side by movement of the rack until the claw assembly engages a refuse can. Closing the claw assembly secures the refuse can. The extension arm is then rotated upwards and the refuse can's contents are dumped into the container. Thereafter, the extension arm is returned to its lowered position and the refuse can is released by the claw assembly. Pivoting the extension arm about a position adjacent to the lower rail tends to exert excessive torque on the rack causing deformation of the rack. After the container is filled, it is then emptied into the refuse truck.

The Bear Claw only permits refuse cans to be emptied from one side of the refuse truck. If refuse cans are located on the other side of the refuse truck then the disposal company must purchase a different Bear Claw with the arm and claw assembly operating in the other direction. Alternatively, the disposal company may drive down the street in the opposite direction.

What is therefore desired is a container that empties refuse cans using a rail system that minimizes torques on the rail and rack. Additionally, the container should eliminate the need for a separate container in order to empty refuse cans from the opposite side of the refuse truck.

SUMMARY OF THE PRESENT INVENTION

The present invention overcomes the aforementioned drawbacks of the prior art by providing a dumping apparatus for a front loading refuse truck having a lifting mechanism for engaging a container and dumping its contents into the truck. The container has at least one upright side and supports for engagement by the refuse truck lifting apparatus. A rail having a first end and a second end is connected to the side of the container and an elongate sliding member is horizontally slidably connected to the rail. An elongate extension member connected between the container and sliding member is movable between a retracted position and an extended position so as to move the sliding member horizontally.

A first end of an elongate extension arm is rotatably connected to the sliding member. A clamp assembly to grasp objects therein is connected to a second end of the extension arm which is rotatable from a first lowered position to a second raised position to enable objects grasped by the clamp assembly to be emptied into the container.

In one aspect of the present invention the extension member is detachably interposed between the container and the sliding member at the second end of the rail. The rail is reversibly attachable to the container so that its first end can face in either direction. The ability of both the extension member to be detachable from the container and the rail to be reversibly connected in the opposing direction, allows the same dumping apparatus to be used to empty objects from either side of the truck.

In another aspect of the present invention the elongate extension member has a central axis. A central axis of the elongate sliding member is aligned substantially with the central axis of the extension member. The elongate extension arm has a first end that is about a horizontal axis rotatably connected to the sliding member which bisects the central axis of the sliding member. By aligning the central axis of the extension member with the central axis of the sliding member, the torques applied to the rail and sliding member are reduced. Furthermore, by locating the extension arm about a horizontal axis which bisects the central axis of a sliding member the torques applied to the rail and sliding member are further reduced.

In still another aspect of the present invention the first end of the elongate extension arm is connected to a rotating member. The rotating member is connected to the sliding member and defines a horizontal axis. A substantial length of the extension arm defines a central axis that bisects the horizontal axis at the connection between the extension arm and the rotating member. By aligning the central axis of the extension arm with the connection between the extension arm and the rotating member, any torques applied to the rotating member by lifting objects with the extension arm will be properly directed to minimize wear on the rotating member.

The foregoing and other objectives, features, and advantages of the invention will be more readily understood upon consideration of the following detailed description of the invention, taken in conjunction with the accompanying drawings.

DETAILED DESCRIPTION OF THE PREFERRED EMBODIMENT

Figure 1:
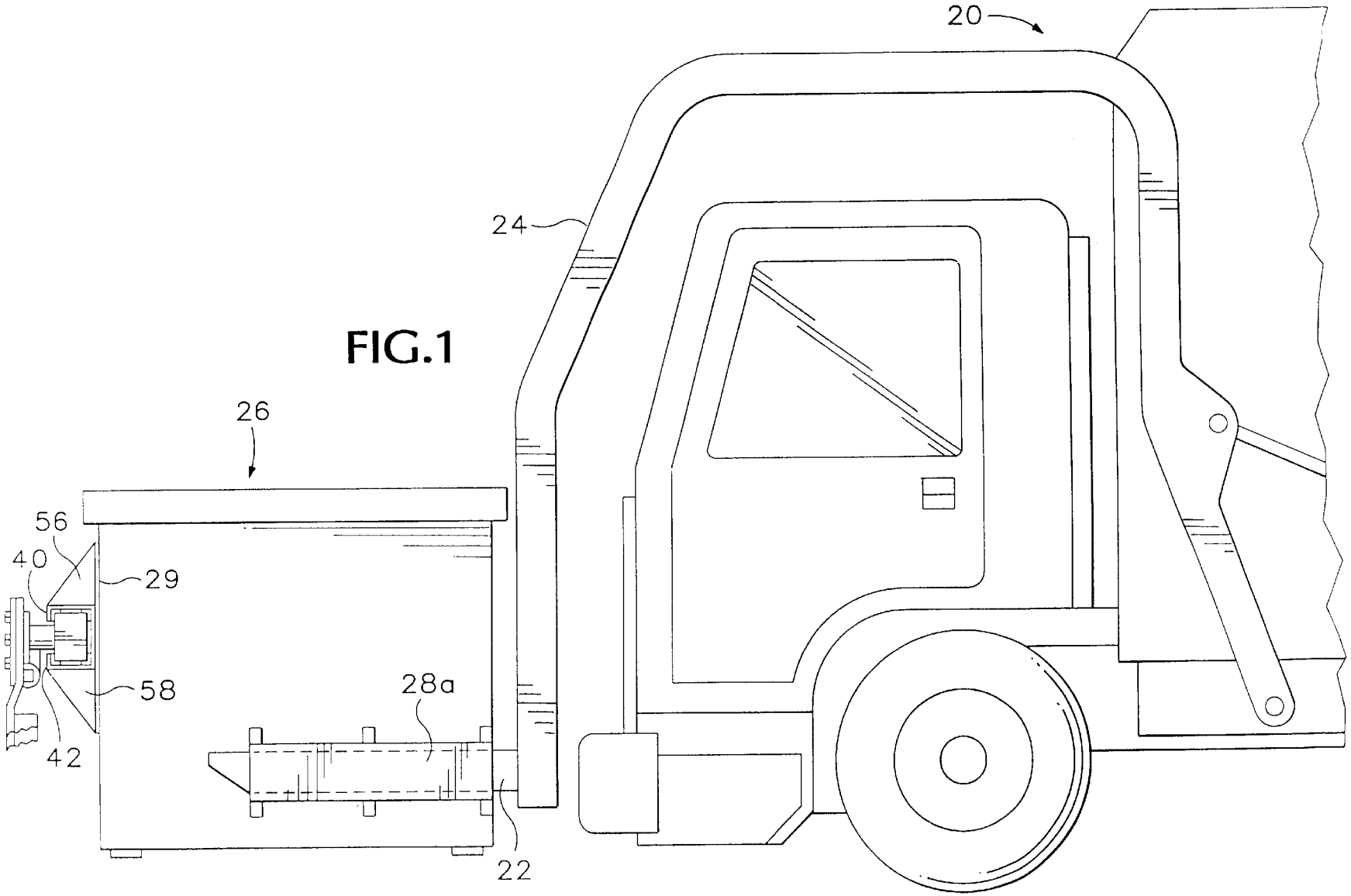
FIG. 1 is a partial side view of a front loading refuse truck engaged with a container embodying the present invention.

Referring to FIG. 1 a front loading refuse truck 20 has a lifting mechanism that includes a pair of spaced-apart forwardly extending forks 22 affixed to a pair of moveable arms 24. The truck 20 is engaged with a container 26 by moving the forks 22 into a pair of hollow tubular supports 28*a* and 28*b* sized and positioned for receiving the forks 22 therein. The tubular supports 28*a* and 28*b* are solidly connected to respective sides of the container 26, preferably in a parallel relationship at a height coincident with that of the forks 22. After the container 26 is filled with waste materials, such as debris and household waste, the moveable arms 24 raise the container 26 dumping its contents into the refuse truck 20. Thereafter, the moveable arms 24 lower the container 26 to its lowered position.

Figure 2:
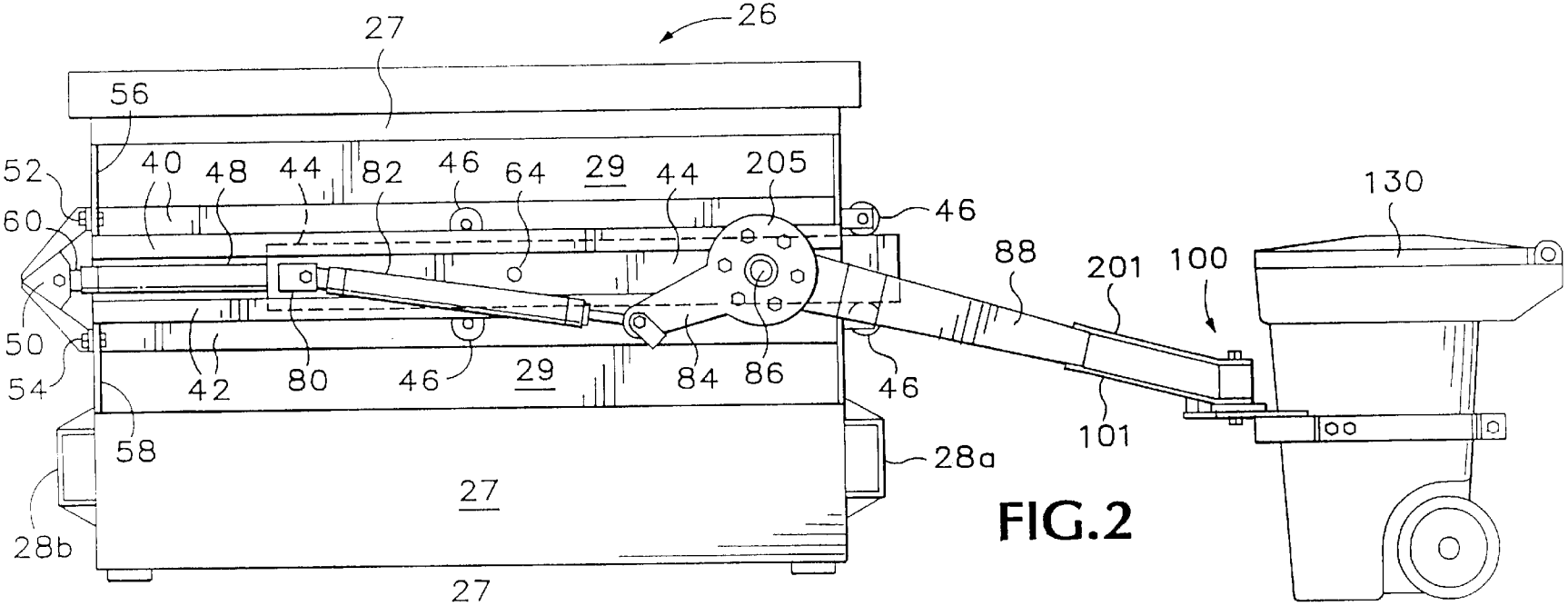
FIG. 2 is a front view of the container shown in FIG. 1 including a clamp assembly and refuse can.
Figure 3:
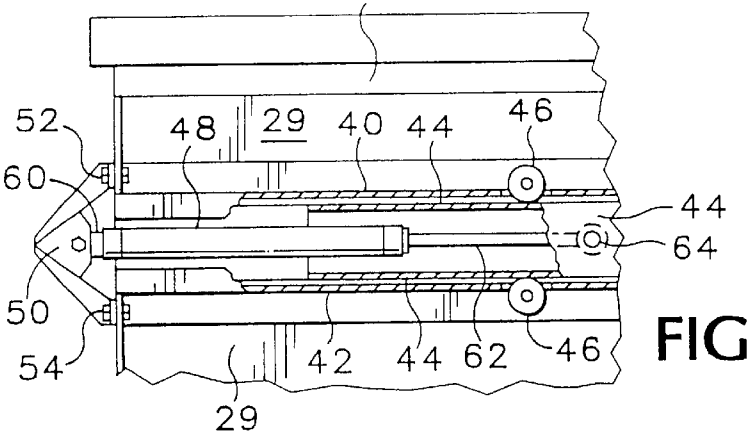
FIG. 3 is a partial sectional view of a portion of the rails, rollers and hollow bar shown in FIG. 2.

Referring to FIG. 2 a front view of the container 26 of FIG. 1 is shown including a clamp assembly 100 and a refuse can 130. A pair of slide rails 40 and 42, preferably thick L shaped steel, are affixed in a horizontal orientation to a backing plate 29 which is in turn detachably affixed to the front 27 of the container 26. A hollow bar 44 is slidably mounted on the rails 40 and 42 with multiple rollers 46 or a high density plastic bearing material. The rollers 46 reduce the friction between the hollow bar 44 and the rails 40 and 42, as more clearly shown in FIG. 3, and are preferably secured in place to the inside of the rails 40 and 42. An extendable-retractable cylinder 48 is affixed at one end 60 to an end cap housing 50 that is bolted with four bolts 52 and 54 to respective flanges 56 and 58. The other end 62 of the cylinder 48 extends into the hollow bar 44 and is attached to it by a pin 64. The cylinder 48 is preferably hydraulic, but other types of extendable-retractable members are also acceptable. By extension and retraction of the cylinder 48, the hollow bar 44 will slide along the rails 40 and 42. The central axis of the cylinder 48 is aligned substantially with the central axis of the hollow bar 44, which is in turn centered between the rails 40 and 42 so that the extension and retraction of the cylinder 48 does not exert excessive torque on the rails 40 and 42 or hollow bar 44.

Referring again to FIG. 2, a support 80 is attached to the exterior of the hollow bar 44, preferably at an elevation substantially equal to that of the elevation of the central axis of the hollow bar 44. A cylinder 82, similar to cylinder 48, is pivotably attached at one end to the support 80 and pivotably attached at the other end to an extension plate 84. A rotatable bearing hub 86 is affixed to the hollow bar 44 preferably at substantially the same elevation as the support 80. An extension arm 88 with a circular end portion 203 is affixed to the bearing hub 86 and the extension plate 84 that also has a circular portion 205, preferably with the same shape as the circular end portion 203, is attached with bolts in a downwardly directed direction relative to the extension arm 88, as shown in FIG. 2. The bearing hub 86 has a central axis that preferably substantially bisects the central axis of the hollow bar 44. By extending and retracting the cylinder 82, the end of the extension arm 88 rotates about the bearing hub 86 to raise and lower the extension arm 88. Aligning the cylinder 82 and the bearing hub 86 at an elevation substantially in the center of the hollow bar 44 reduces the torque applied to the bar 44 and the rails 40 and 42 when raising and lowering the extension arm 88. A substantial length of the extension arm 88 defines a central axis that preferably substantially bisects the horizontal axis of the bearing hub 86 at the connection between the extension arm 88 and the bearing hub 86. Aligning the central axis of the extension arm 88 in this way helps to reduce torques on the bearing hub 86.

Figure 4:
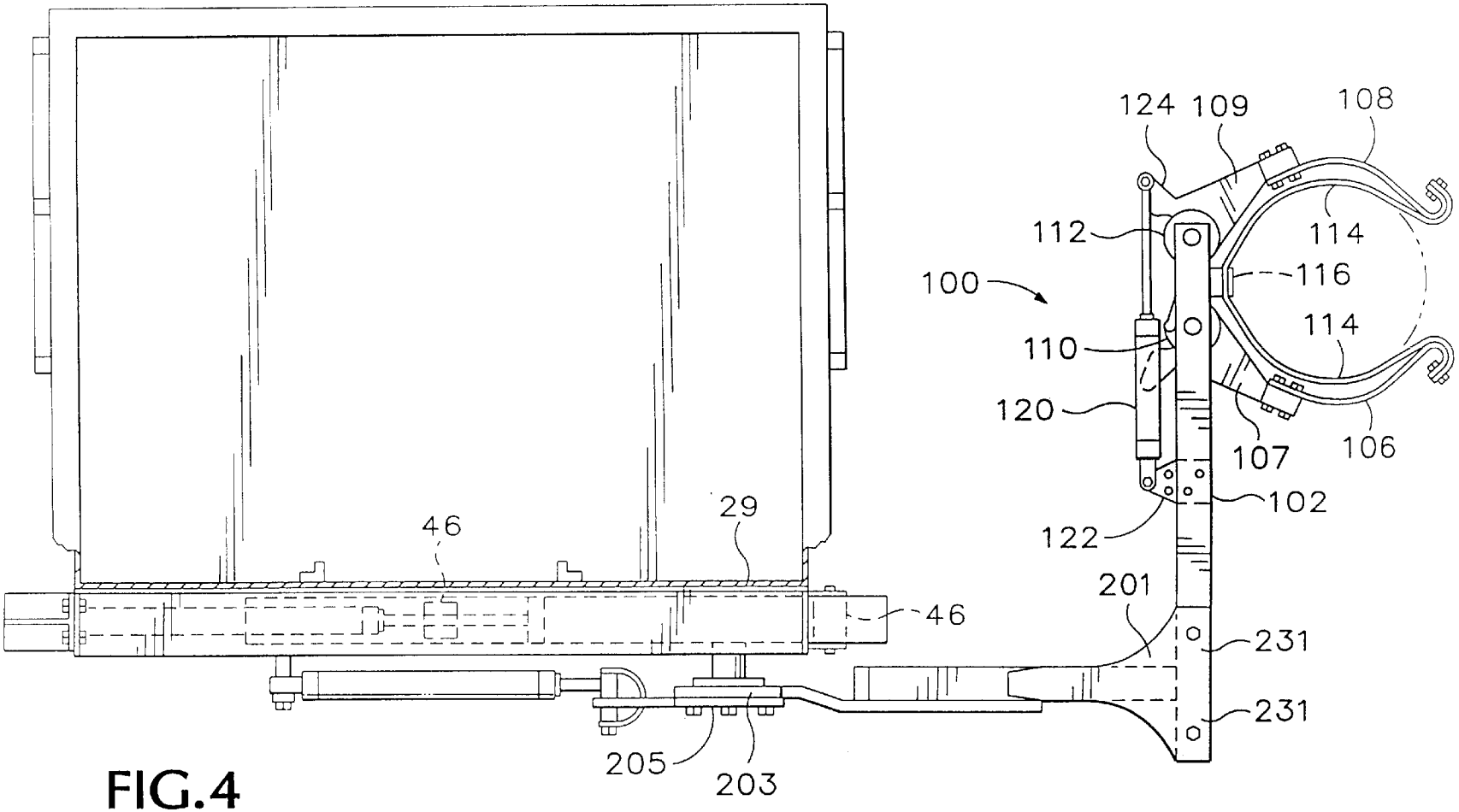
FIG. 4 is a top view of the container and clamp assembly shown in FIG. 2.

Referring to FIG. 4, a clamp assembly 100 for gripping objects is connected to the end of the extension arm 88. The clamp assembly 100 includes a transverse arm 102 securely affixed to the end of the extension arm 88 by means of a receptacle tube 231. The tube 231 receives the transverse arm 102, which has an outside diameter that matches the inside diameter of the tube 231, and is bolted in place. A pair of flexible curved clamp arms 106 and 108 are bolted to respective extension members 107 and 109 that are in turn rotatably connected to the transverse arm 102 by a pair of bearing hubs 110 and 112, respectively. Each end of a flexible strap 114 is attached to the respective end of clamp arms 106 and 108, and the center of strap 114 is attached to a support member 116 by bolts. Attaching the strap 114 in such a manner maintains its position within the area defined by the clamp arms 106 and 108 and exerts a relatively even pressure while gripping an object. Additionally, the flexible strap 114 should have a non-slip surface and sufficient elasticity so that objects 130 gripped by the clamp assembly 100 are not damaged.

Figure 6:
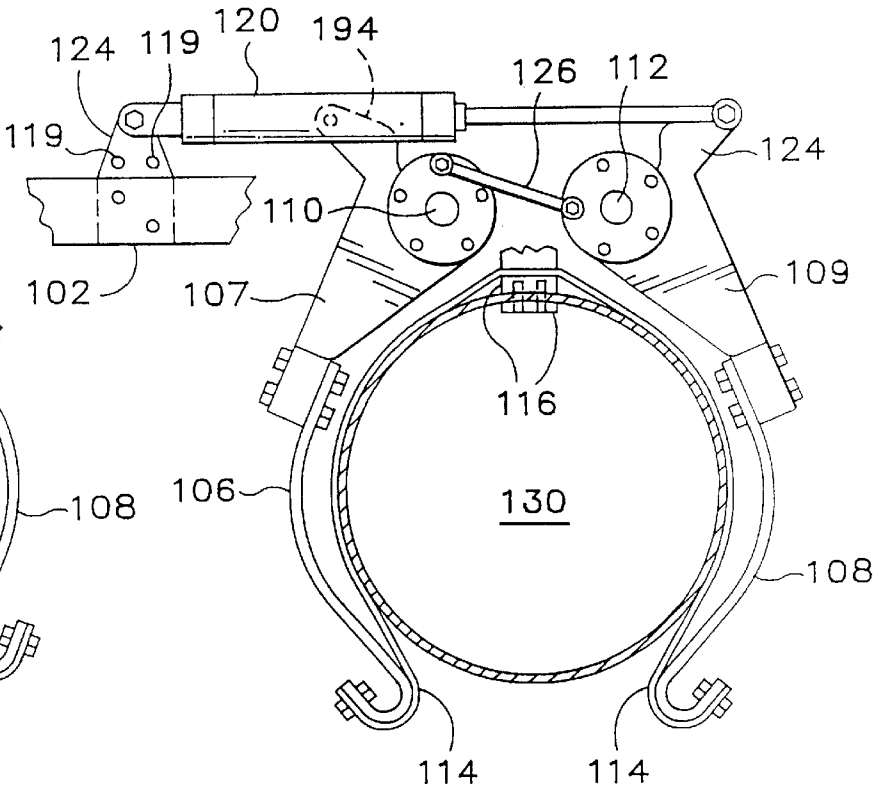
FIG. 6 is a top view of the clamp assembly, shown closed about a section of a refuse can, with a portion of the transverse arm broken away.
Figure 5:
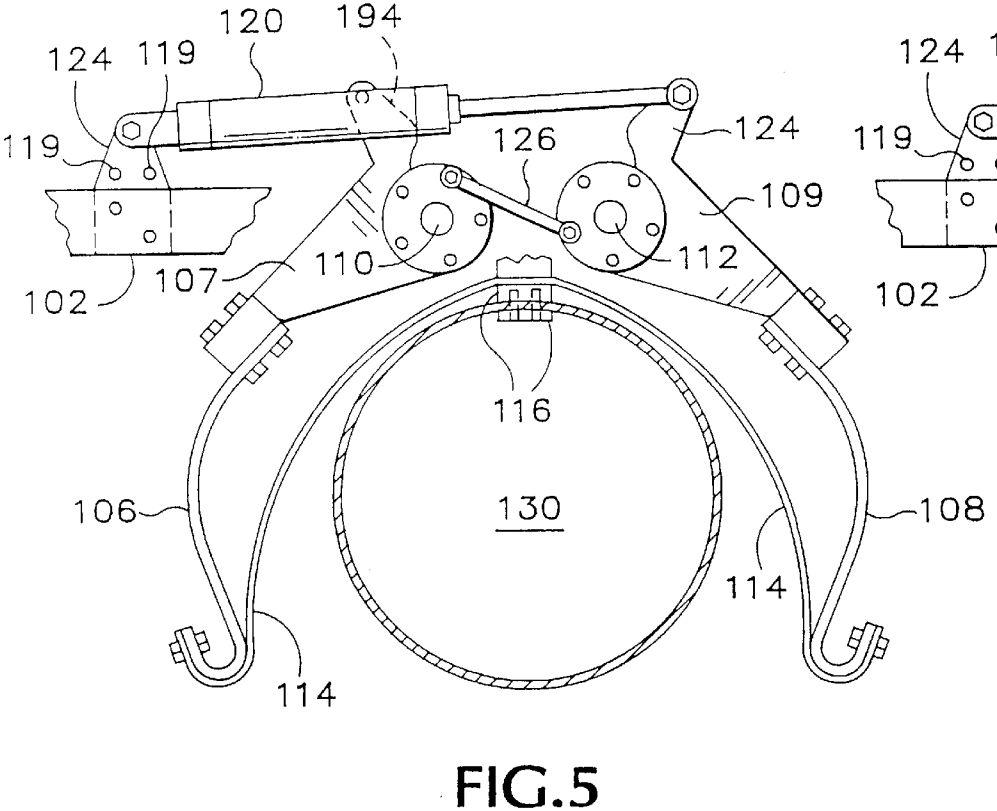
FIG. 5 is a top view of the clamp assembly, shown opened about a section of a refuse can with a portion of the transverse arm broken away.

One end of an extendable-retractable cylinder 120 is bolted to a support 122, that is in turn connected to the transverse arm 102. The other end of the cylinder 120 is pivotably connected to a tab 124 of the extension member 109. The cylinder 120 is preferably a hydraulic cylinder, though other types of extendable-retractable members may also be used. A tie arm 126, more clearly shown in FIG. 5, is pivotably connected in an angular relationship between the extension members 107 and 109. By extending the cylinder 120, the extension member 109 is rotated clockwise around the bearing 112, thereby, closing the clamp arm 108 around the object 130. As clamp arm 108 rotates, the tie arm 126 causes extension member 107 to rotate counterclockwise, thereby, also closing clamp arm 106 around the object 130. The clamping action of both clamp arms 106 and 108 firmly grips the object 130 with the flexible strap 114, as shown in FIG. 6. By retracting the cylinder 120, the clamp arms 106 and 108 open, releasing the object 130. A stop pin 119 limits the extent to which the clamp arms may open. The object 130, is preferably a refuse or trash can.

Figure 7:
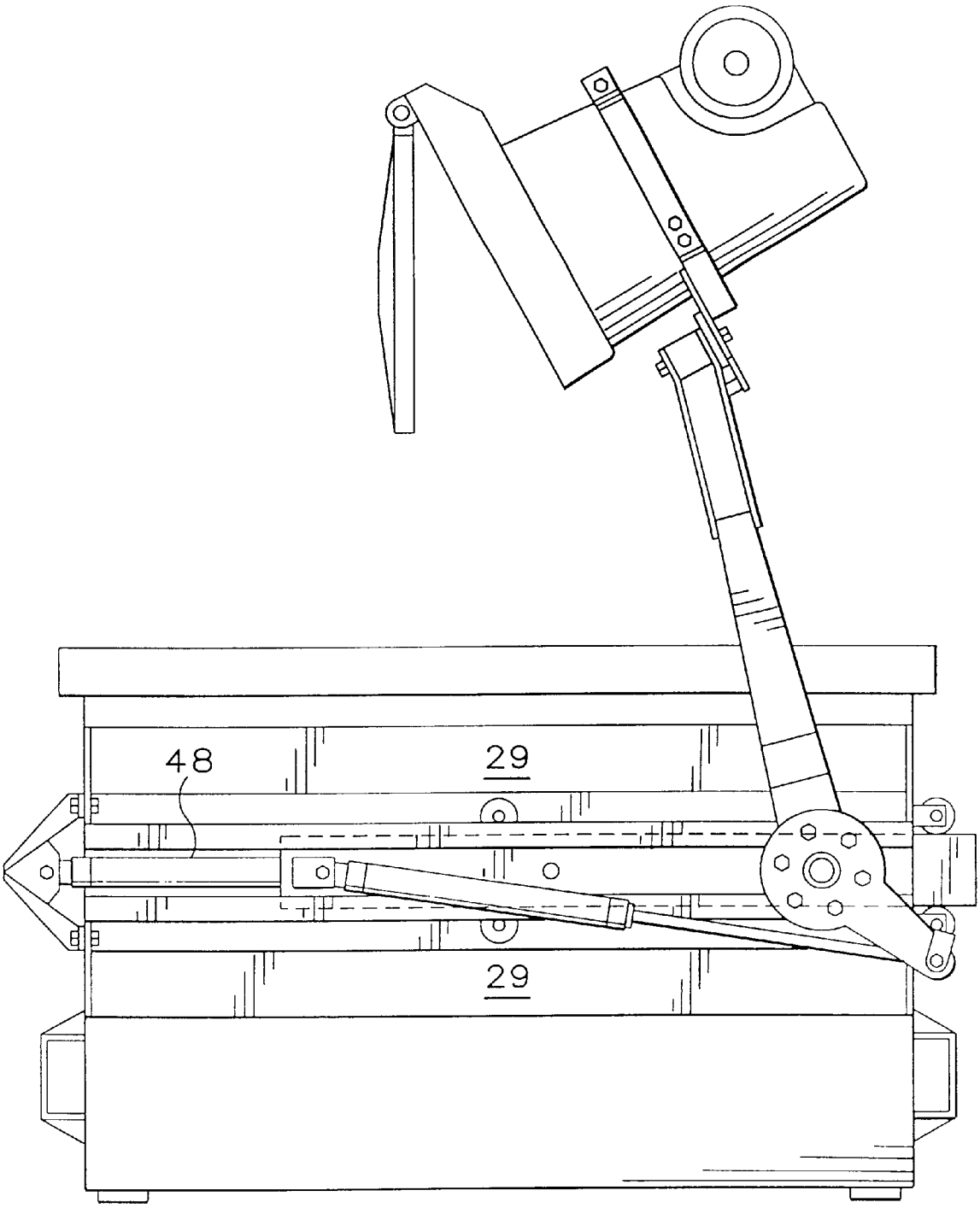
FIG. 7 is a front view of the container and clamp assembly shown in FIG. 2 with the refuse can in a raised position.

The refuse truck 10, with an engaged container 26, drives alongside an object 130 with the clamp assembly 100 in the opened position. The cylinder 48 is extended to move the clamp arms 106 and 108 of the clamp assembly 100 around the object 130. The cylinder 120 is then extended, closing the clamp arms 106 and 108 securely gripping the object 130. After gripping the object 130 the cylinder 82 is extended raising the object 130 above the open container 26, as shown in FIG. 7, to dump its contents into the container 26. Thereafter, the cylinder 82 is retracted to lower the object 130 to the ground and the clamp arms 106 and 108 are opened by retracting cylinder 120 to release the object 130. Finally, the cylinder 48 is retracted to remove the clamp arms from the object 130. The refuse truck 10 may then continue to empty more objects 130 until the container 26 is filled. After the container 26 is filled, the moveable arms 24 are raised such that the contents of the container 26 are dumped into the truck 20, and then the container 26 is lowered down to resume emptying objects 130.

Figure 8:
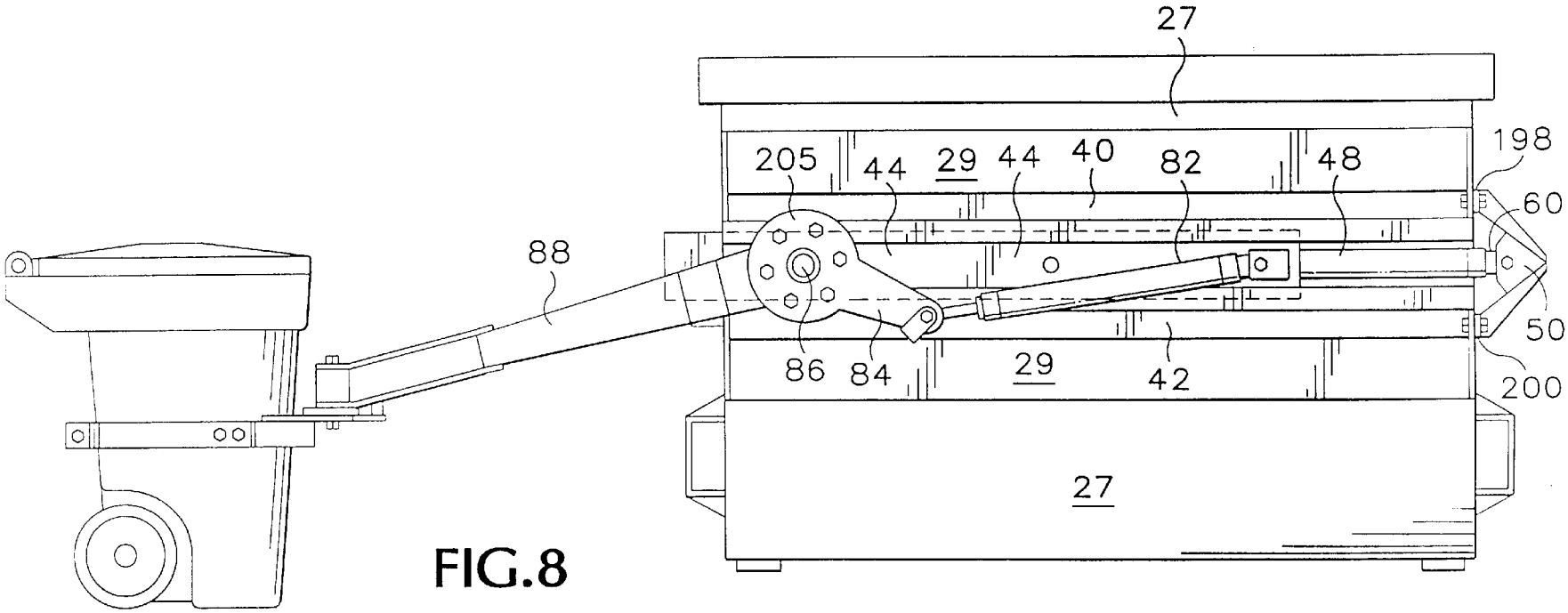
FIG. 8 is a front view of a container with the clamp assembly mounted to grasp a refuse can from the opposite side from that shown in FIG. 2.

Referring to FIG. 8, the container 26 is designed to permit the reversal of the extension arm 88 so that objects 130 can be grasped from the other side of the refuse truck 20. The cylinder 48 is detached from the housing 50, and the bolts 52 and 54 are removed to detach the housing 50 from the left hand side of the container 26. Next, the hollow bar 44 and all attached members may be slid out of either end of the rails 40 and 42. The extension plate 84 and the extension arm 88 are both unbolted from the bearing hub 86 and then the end portions 203 and 205 are rebolted to the bearing hub 86 so that when the direction of the hollow bar 44 is reversed the extension of the cylinder 82 still raises the extension arm 88.

The transverse arm 102 is removed from the receptable tube 231 and reinstalled in the opposite direction on the opposite side of the extension arm 88. The hollow bar 44 and extension arm 88 are reversed so that the downwardly facing surface of the extension arm 88 is now the upwardly facing surface of the extension arm 88. The clamp assembly 100 is detached from the transverse arm 102 and reattached to the other side of the transverse arm 102 in the opposing direction. The cylinder 120 is detached from tab 124 and reattached to tab 194. The extension members 107 and 109 are unbolted from bearing hubs 110 and 112, and the tie arm 126 is shifted by rotating the bearing hubs 110 and 112 to operate the clamp assembly in the opposing direction. Thereafter, the extension members 107 and 109 are rebolted to the bearings hubs 110 and 112. Accordingly, the transverse arm 102 and clamp assembly 100 maintains its horizontal alignment, as shown in FIG. 8. At least the two rollers 46 at the side of the container 26 are relocated to the other side of the container 26. The hollow bar 44 is slid back into engagement with the rails with its ends reversed. The housing 50 is rebolted onto flanges 198 and 200 on the right side of the container 26. The end 60 of cylinder 48 is reattached to housing 50.

By designing the clamp assembly loo and extension arm 88 to be directed in either direction the same container 26 can be used to empty objects 30 on either side of the container, as desired. This eliminates the need to have a separate container for each direction, thereby realizing a substantial savings in only requiring one container.

In an alternative embodiment, two sets of the rails, extension arm, clamp assembly, etc. could be provided, each one directed in the opposite direction. This avoids the need to reverse the direction of the clamp assembly for emptying objects on alternate sides of the refuse truck.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A dumping apparatus for a front loading refuse trick having a lifting mechanism for engaging a container and dumping its contents into the truck, said apparatus comprising:

(a) a container having at least one upright side;

(b) said container having supports for engagement by the refuse truck lifting mechanism;

(c) an elongate rail connected to said side of said container;

(d) an elongate sliding member having a central axis and horizontally slidably connected to said rail;

(e) an elongate extension member having a central axis and movable between a retracted position and an extended position, a first end of said extension member connected to said container, a second end of said extension member connected to said sliding member, said central axis of said extension member aligned substantially with said central axis of said sliding member;

(f) an elongate extension arm having a first end that is rotatably connected to said sliding member about a horizontal axis which bisects said central axis of said sliding member;

(g) a clamp assembly to grasp objects connected to a second end of said extension arm; and (h) said extension arm rotatable between a lowered position and a raised position to enable objects grasped by said clamp assembly to be emptied into said container.

2. The dumping apparatus of claim 1, further comprising one of a bushing and a roller positioned between said sliding member and said rail.

3. The dumping apparatus of claim 1, further comprising a backing plate disposed between said rail and said side of said container so as to support said rail on said container.

4. The dumping apparatus of claim 1, further comprising a rotating member rotatably connecting said extension arm to said sliding member, a substantial length of said extension arm defining a central axis, said central axis of said extension arm bisecting said horizontal axis at the connection between said extension arm and said rotating member.

5. The dumping apparatus of claim 1 wherein said clamp assembly further comprises a transverse arm having a first end and second end, said first end of said transverse arm affixed to said extension arm, and a pair of clamp arms which are affixed to said second end of said transverse arm.

6. The dumping apparatus of claim 1 wherein said rail has a first end and a second end, said extension member being detachably interposed between said container and said sliding member at said second end of said rail, said rail being reversibly attachable to said container so that its first end can face in either direction.

7. The dumping apparatus of claim 6 further comprising said extension arm being reversibly attachable to said sliding member so that said clamp assembly is orientated to grasp objects when said rail is reversed.

8. A dumping apparatus for a front loading refuse truck having a lifting mechanism for engaging a container and dumping its contents into the truck, said apparatus comprising:

(a) a container having at least one upright side;

(b) said container having supports for engagement by the refuse truck lifting apparatus;

(c) a rail connected to said side of said container, said rail having a first end and a second end;

(d) an elongate sliding member having a first end, said elongate sliding member being horizontally slidably connected to said rail so that said first end of said sliding member can face either end of said rail;

(e) an elongate extension member movable between a retracted position and an extended position, wherein said extension member is interposed between said container and said sliding member and detachably connected to said container at either of said first end and said second end of said rail;

(f) a first end of an extension arm rotatably connected to said sliding member;

(g) a clamp assembly to grasp objects connected to a second end of said extension arm; and (h) said extension arm rotatable from a first lowered position to a second raised position to enable objects grasped by said clamp assembly to be emptied into said container.

9. The dumping apparatus of claim 8, further comprising said extension arm being reversibly attached to said sliding member so that said clamp assembly is oriented to grasp objects when said sliding member is reversed.

10. The dumping apparatus of claim 8, further comprising one of a bearing and a roller positioned between said sliding member and said rail.

11. The dumping apparatus of claim 8, further comprising said extension member having a central axis, said sliding member having a central axis, said central axis of said extension member aligned substantially with said central axis of said sliding member.

12. The dumping apparatus of claim 11 wherein said first end of said extension arm is rotatably connected to said sliding member about a horizontal axis which bisects said central axis of said sliding member.

13. The dumping apparatus of claim 8, further comprising a rotating member defining a central axis and rotatably connecting said extension arm to said sliding member, a substantial length of said extension arm defining a central axis, said central axis of said extension arm bisecting said central axis defined by said rotating member at the connection between said extension arm and said rotating member.

14. The dumping apparatus of claim 8, further comprising a backing plate disposed between said rail and said side of said container so as to support said rail on said container.

15. The dumping apparatus of claim 8 wherein said clamp assembly further comprises a transverse arm having a first end and a second end, said first end of said transverse arm affixed to said extension arm, a pair of clamp arms affixed to said second end of said transverse arm.

16. The dumping apparatus of claim 15, further comprising said clamp arms being reversibly attachable to said transverse arm so that said clamp assembly is orientated to grasp objects when said sliding member is reversed.

17. A dumping apparatus for a front loading refuse truck having a lifting mechanism for engaging a container and dumping its contents into the truck, said apparatus comprising:

(a) a container having at least one upright side;

(b) said container having supports for engagement by the refuse truck lifting mechanism;

(c) a rail connected to said side of said container;

(d) an elongate sliding member having a central axis and horizontally slidably connected to said rain (e) an elongate extension member having a central axis and movable between a retracted position and an extended position; a first end of said extension member connected to said container; a second end of said extension member connected to said sliding member, said central axis of said extension member aligned substantially with said central axis of said sliding member;

(f) a first end of an elongate extension arm connected to a rotating member, said rotating member connected to said sliding member, said rotating member defining a horizontal axis, a substantial length of said extension arm defining a central axis that bisects said horizontal axis at the connection between said extension arm and said rotating member;

(g) a clamp assembly to grasp objects connected to a second end of said extension arm; and (h) said extension arm rotatable from a first lowered position to a second raised position to enable objects grasped by said clamp assembly to be emptied into said container.

18. The dumping apparatus of claim 17, further comprising one of a bearing and a roller positioned between said sliding member and said rail.

19. The dumping apparatus of claim 17, further comprising a backing plate disposed between said rail and said side of said container so as to support said rail on said container.

20. The dumping apparatus of claim 17 wherein said clamp assembly further comprises a transverse arm having a first end and second end, said first end of said transverse arm affixed to said extension arm, a pair of clamp arms affixed to said second end of said transverse arm.

21. The dumping apparatus of claim 20, further comprising said clamp arms being reversibly attachable to said transverse arm so that said clamp assembly is orientated to grasp objects when said rail is reversed.

22. The dumping apparatus of claim 17 wherein said rail has a first end and a second end, said extension member is detachably interposed between said container and said sliding member at said second end of said rail, said rail being reversibly attachable to said container so that its first end can face in either direction.

23. The dumping apparatus of claim 22, further comprising said extension arm being reversibly attachable to said sliding member so that said clamp assembly is orientated to grasp objects when said rail is reversed.

* * * * *

UNITED STATES PATENT AND TRADEMARK OFFICE

CERTIFICATE OF CORRECTION

PATENT NO. : 6,139,244
DATED : October 31, 2000
INVENTOR(S) : Wayne B. VanRaden

It is certified that error appears in the above-identified patent and that said Letters Patent is hereby corrected as shown below:

Column 6,
Line 4, change “100” to -- 100 --
Line 24, change “trick” to -- truck --

Column 8,
Line 19, change “rain” to -- rail --

Signed and Sealed this

Twenty-seventh Day of August, 2002

*Attest:*

*Attesting Officer*

JAMES E. ROGAN
*Director of the United States Patent and Trademark Office*